US005853329A

United States Patent [19]

Worlds et al.

[11] Patent Number: 5,853,329

[45] Date of Patent: Dec. 29, 1998

[54] WHIRL AROUND TOY

[76] Inventors: Darinelle V. Worlds; Maurice Worlds, both of 120 Creek Dr., Leesburg, Ga. 31763

[21] Appl. No.: 884,217

[22] Filed: Jun. 27, 1997

[51] Int. Cl.[6] ..... A63G 1/20

[52] U.S. Cl. ..... 472/25; 472/135

[58] Field of Search ..... 472/25, 40, 41, 472/135, 102; 297/245

[56] References Cited

U.S. PATENT DOCUMENTS

| | | | |
|---|---|---|---|
| 2,999,688 | 9/1961 | Gabrielson | 472/25 |
| 3,749,399 | 7/1973 | Fedor et al. | 472/25 |
| 4,084,273 | 4/1978 | Haynes | 5/105 |
| 5,415,589 | 5/1995 | Hall, Jr. | 472/25 |
| 5,603,662 | 2/1997 | Kreaman-Stern | 472/25 |

*Primary Examiner*—Kien T. Nguyen

[57] ABSTRACT

A whirl around toy including a general spherical member that has a hollow body with an upper end. The upper end has an opening defining a recessed portion projecting inward from the upper end. The recessed portion have a front wall, a back wall and a floor. The back wall has a ledge capable of receiving a child in a seated position. Also, included is a ring. The ring has an inner circular edge with at least four protrusions. The ring is positioned around the spherical member with each of the four protrusions positioned within the notches for securing the ring. The ring has a pair of steps coupled thereto for use by the child to enter the recessed portion.

4 Claims, 3 Drawing Sheets

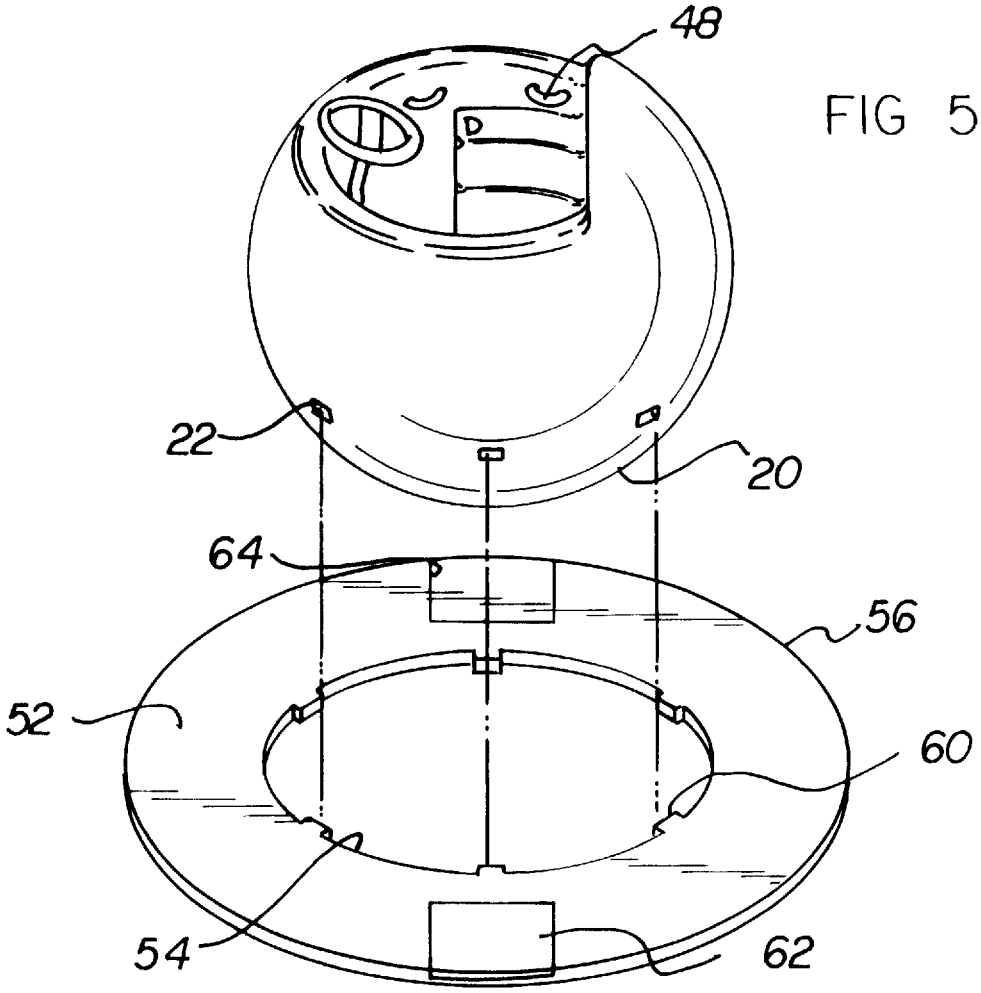
FIG 5
FIG 6
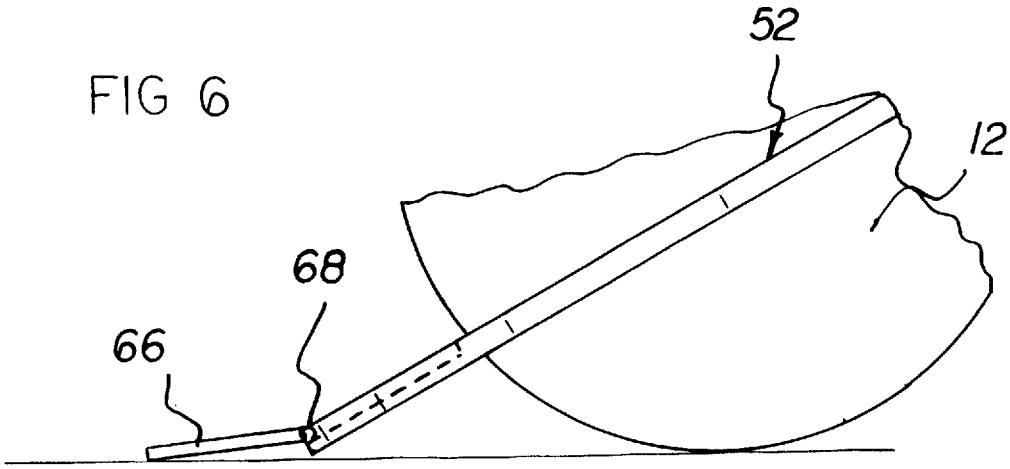

WHIRL AROUND TOY

BACKGROUND OF THE INVENTION

1. Field of the Invention

The present invention relates to a whirl around toy and more particularly pertains to providing a toy for children to sit in that allows them to rock back and forth while moving in a circular direction along a flat surface.

2. Description of the Prior Art

The use of a spherical toy is known in the prior art. More specifically, Spherical toys heretofore devised and utilized for the purpose of entertaining movement are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,729,446 to Sefton discloses a mobile sphere. The sphere of Sefton's is formed from a plurality of contra spiraling members that extend through 360 degrees from one end of an axis to the other to form a geodesic frame. The sphere is adapted to seat a user within the hollow of the sphere.

U.S. Pat. No. 4,621,622 to Beck discloses an apparatus for entertainment, therapeutic uses and the like. Beck's patent discloses a plurality of pivotal elements secured to a plurality of frame elements. This prior art invention is capable of assuming a spherical shape.

U.S. Pat. No. 4,501,569 to Clark and Green discloses a spherical vehicle control system. The control system has a drive shaft with a motor connected. The spherical vehicle control system provides for continuous steering of a vehicle.

Lastly, U.S. Pat. No. 4,458,895 to Turcotte discloses a spherical recreational hollow body. Turcotte's invention has a portal for exit and entry of an occupant. This patent includes circumferential ribs that have anti-skip material. The occupant moves the sphere by walking within the sphere.

While these devices fulfill their respective, particular objectives and requirements, the aforementioned patents do not describe a whirl around toy that provides a child between the ages of 2–5½ a spherical rocking toy that rocks back and forth, while moving in a circular direction, without tilting the child over onto their head.

In this respect, the whirl around toy according to the present invention substantially departs from the conventional concepts and designs of the prior art, and in doing so provides an apparatus primarily developed for the purpose of providing a toy for children to sit in that allows them to rock back and forth while moving in a circular direction along a flat surface.

Therefore, it can be appreciated that there exists a continuing need for a new and improved whirl around toy which can be used for providing a toy for children to sit in that allows them to rock back and forth while moving in a circular direction along a flat surface. In this regard, the present invention substantially fulfills this need.

SUMMARY OF THE INVENTION

In view of the foregoing disadvantages inherent in the known types of spherical toys now present in the prior art, the present invention provides an improved whirl around toy. As such, the general purpose of the present invention, which will be described subsequently in greater detail, is to provide a new and improved whirl around toy and method which has all the advantages of the prior art and none of the disadvantages.

To attain this, the present invention essentially comprises a general spherical member that has a hollow body with an upper end. The upper has an opening that defines a recessed portion that projects inward from the upper end. The spherical member has a lower end and a plurality of notches therearound. The recessed portion has a front wall with a steering mechanism attached. The recessed portion has a back wall with an outwardly extending ledge. The recessed portion has a floor. The ledge receives a child in a seated position. Lastly, a ring is included. The ring has an inner circular edge and an outer circular edge. The inner circular edge has at least four protrusions that project outwardly. The four protrusions are proportionately spaced one from another along the inner edge. The ring is positioned around the spherical member. Each of the four protrusions are positioned within the notches of the spherical member to secure the ring. The ring is capable of restricting the rolling movement of the spherical hollow body. Whereby, the child being seated, on the ledge within the hollow body, is capable of rocking the spherical member with the ring restricting the tilt of the spherical member.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved whirl around toy which has all of the advantages of the prior art spherical toys and none of the disadvantages.

It is another object of the present invention to provide a new and improved whirl around toy which may be easily and efficiently manufactured and marketed.

It is further object of the present invention to provide a new and improved whirl around toy which is of durable and reliable constructions.

An even further object of the present invention is to provide a new and improved whirl around toy which is susceptible of a low cost of manufacture with regard to both materials and labor, and which accordingly is then susceptible of low prices of sale to the consuming public, thereby making such Whirl around toy economically available to the buying public.

Even still another object of the present invention is to provide a whirl around toy for providing a toy for children to sit in that allows them to rock back and forth while moving in a circular direction along a flat surface.

Lastly, it is an object of the present invention to provide a new and improved whirl around toy including a general spherical member that has a hollow body with an upper end. The upper end has an opening defining a recessed portion projecting inward from the upper end. The recessed portion have a front wall, a back wall and a floor. The back wall has a ledge capable of receiving a child in a seated position. Also, included is a ring. The ring has an inner circular edge with at least four protrusions. The ring is positioned around the spherical member with each of the four protrusions positioned within the notches for securing the ring. The ring has a pair of steps coupled thereto for use by the child to enter the recessed portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an exploded view of the present invention with the spherical member separated from the ring.

FIG. 6 is a side view of the step in an extended orientation.

The same reference numerals refer to the same parts through the various Figures.

DESCRIPTION OF THE PREFERRED EMBODIMENT

Figure 1:
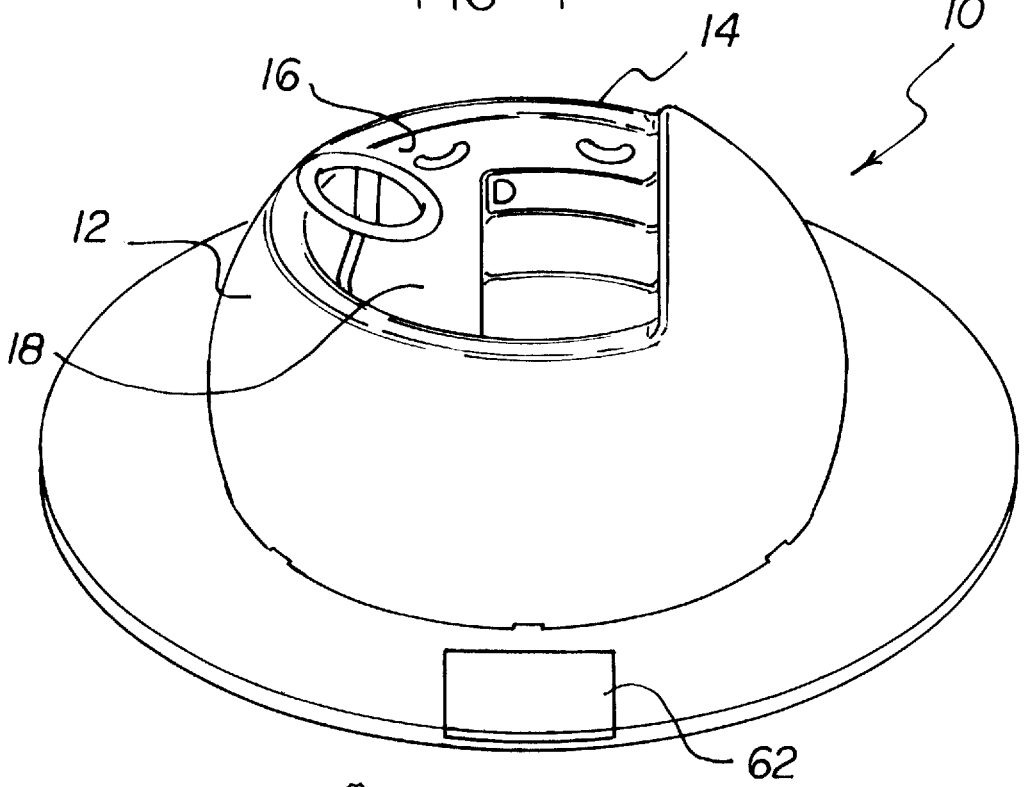
FIG. 1 is a perspective view of the preferred embodiment of the whirl around toy constructed in accordance with the principles of the present invention.

With reference now to the drawings, and in particular to FIG. 1 thereof, the preferred embodiment of the new and improved Whirl around toy embodying the principles and concepts of the present invention and generally designated by the reference numeral 10 will be described.

The present invention, the whirl around toy 10 is comprised of a plurality of components. Such components in their broadest context include a top portion, a bottom portion and a ring. Such components are individually configured and correlated with respect to each other so as to attain the desired objective.

Specifically, the present invention includes a general spherical member 12. The spherical member has a hollow body with an upper end 14. The upper end has an opening 16 that defines a recessed portion 18, as seen in FIG. 1. The spherical member has a lower end 20, as seen in FIG. 5. The spherical member has a plurality of notches 22 therearound. The notches are spaced from the lower end and about the circumference of the spherical member.

Figure 2:
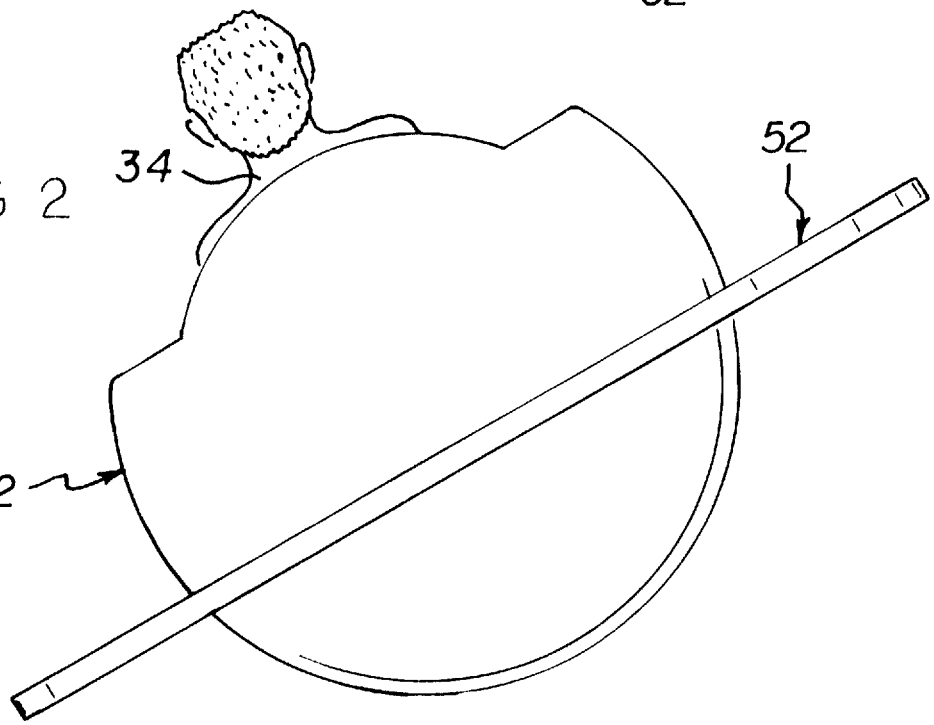
FIG. 2 is a rear view of the present invention in an operable orientation.
Figure 3:
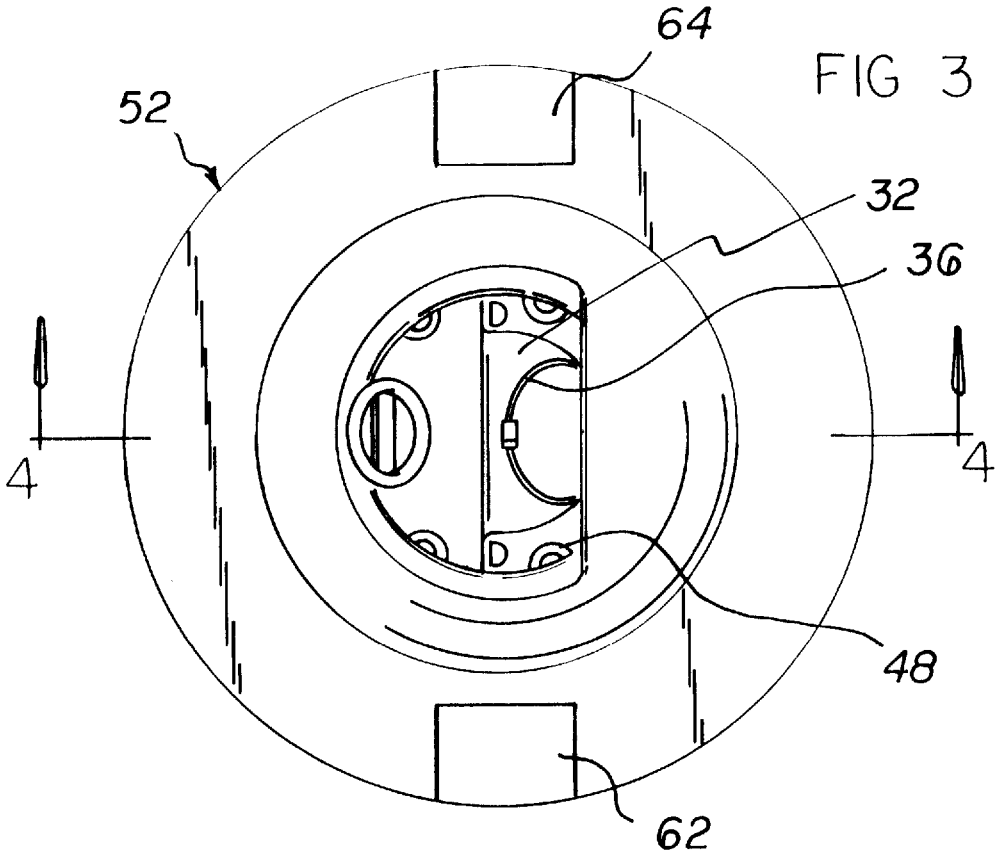
FIG. 3 is a top plan view of the present invention of FIG. 1.
Figure 4:
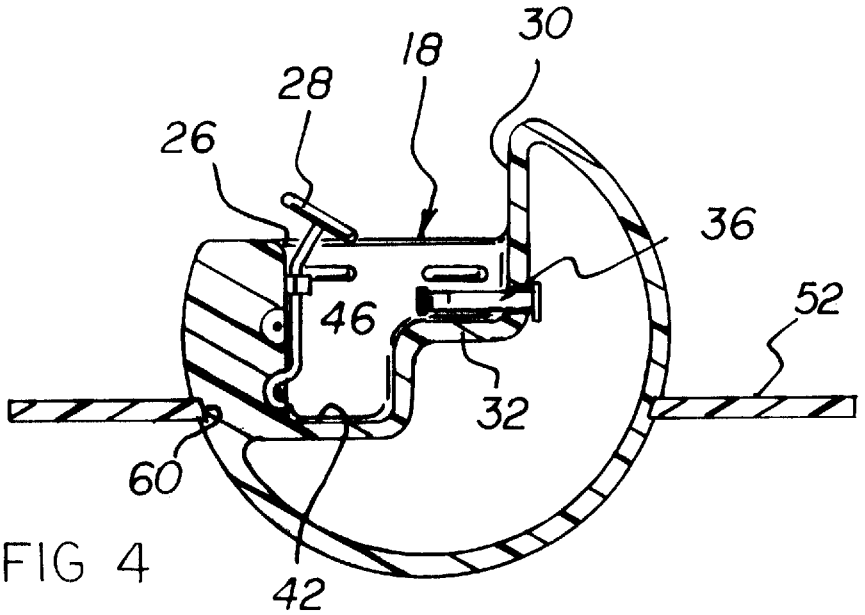
FIG. 4 is a cross sectional view of the present invention taken along line 4—4 of FIG. 3.

The recessed portion has a front wall 26. Mounted to the front wall, as seen in FIG. 4, is a steering mechanism 28. The recessed portion has a back wall 30 with an outwardly extending ledge 32. The ledge is capable of receiving a child 34 in a seated position, as shown in FIG. 2. The back wall has a pair of seat belts 36 that are used to secure the child safely within the top portion.

Also, the recessed portion has a floor 42 and a pair of side walls 46. Each side wall has a pair of handles 48. The child, when seated in the recessed portion, can hold onto the handles or the steering mechanism.

Additionally, a ring 52 is included. The ring has an inner circular edge 54 and an outer circular edge 56. The inner circular edge, as depicted in FIG. 5, has a at least four protrusions 60. Each potrusion projecting outwardly from the inner circular edge. The four protrusions, as seen in FIG. 5 are proportionately spaced one from another along the inner edge. One of each of the protrusions is sized for snap fit coupling with one of the respective notches 22 of the spherical member.

Furthermore, The ring is positioned around the spherical member 12. Each of the four protrusions is positioned within one of the notches 22 for securing the ring around the spherical member. The ring is capable of restricting the rolling movement of the spherical hollow body. Whereby, the child, seated on the ledge within the spherical hollow body, is capable of rocking the spherical body with the ring restricting the tilt of the spherical body.

Lastly, the ring has a pair of steps 62 and 64. The steps are spaced apart on opposite sides of the ring. The spacing of the steps about the ring is important because the weight of the steps, if positioned improperly, will affect the balance of the whirl around toy. Each step, as depicted in FIG. 6, has a single extent coupled with a pivot pin 68. The extent folds and unfolds with respect to the ring. When the steps are folded the extent is positioned within the ring. When the extent of each step is unfolded, the extent stands on the receiving surface. The steps when unfolded are used by the child to enter into or exit out of the recessed portion.

Furthermore, the present may be easily disassembled and stored. FIG. 5 shows the ring may be separated from the spherical member for storage. This will allow storage of the present invention without fear of the child attempting to climb in alone.

The present invention, whirl around toy, is made from a rigid plastic. The plastic used is any commercially available plastic currently used in children's toys. The child would enter the recessed portion by tilting the toy to one side and extending the steps. The extents will act as an anchor to keep the toy from moving as the child climbs up the steps. The child would exit the toy in a like manner. Once the child is seated in the spherical member, the child is strapped in with the seat belts. The steps are place winthin a carved out portion on the top of the ring and the child can rock the toy back and forth. The child is able to use the steering mechanism or any of the handles to assist in his movement. The toy is structured to accommodate a child between the ages of 2 to 5½. Children at this age are very active and would enjoy being able to rock the toy back and forth or in a circular direction. As the child rocks the toy, the ring keeps the toy from tilting the child onto his head.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved whirl around toy for recreational use by a child when seated within comprising in combination:

a general spherical member having a hollow body with an upper end, the upper end having an opening defining a recessed portion that projects inward therefrom, the spherical member having a lower end and a plurality of notches therearound, the notches being spaced from the lower end and about the circumference of the spherical member, the recessed portion having a front wall with a steering mechanism attached thereto, the recessed portion having a back wall with an outwardly extending ledge, the recessed portion having a floor, the outwardly extending ledge being capable of receiving a child in a seated position; and a ring having an inner circular edge and an outer circular edge, the inner circular edge having at least four protrusions projecting outwardly therefrom, each protrusion being proportionately spaced one from another along the inner edge, each protrusion being snap fit coupled with one of the respective notches of the spherical member for positioning the ring around the spherical member, each of the four protrusions when positioned within the notches of the spherical member will secure the ring therearound, the ring being capable of restricting the rolling movement of the spherical member, whereby the child being seated on the ledge within the spherical hollow body being capable of rocking the spherical body with the ring restricting the tilt of the spherical body.

2. A whirl around toy comprising in combination:

a general spherical member having a hollow body with an upper end, the upper end having an opening defining a recessed portion projecting inward from the upper end thereof, the recessed portion having a front wall, a back wall and a floor, the back wall having a ledge capable of receiving a child in a seated position; and a ring having an inner circular edge with at least four protrusions, the ring being positioned around the spherical member with each of the four protrusions being positioned within a notch of the sperical member for securing the ring therearound, the ring having a pair of steps coupled thereto for use by the child to enter the recessed portion.

3. The whirl around toy as set forth in claim 2, wherein the recessed portion of the spherical member having a front wall with a steering mechanism attached.

4. The whirl around toy as set forth in claim 2, wherein the ring having an outer circular edge, and the four protrusions of the inner circular edge projecting outwardly therefrom and being proportionately spaced one from another along the inner edge.

* * * * *